US009430995B1

(12) United States Patent
Paresi

(10) Patent No.: US 9,430,995 B1
(45) Date of Patent: Aug. 30, 2016

(54) HARMONICA AUTOMATIC POSITIONER AND METHOD

(71) Applicant: Joseph D. Paresi, Madison, CT (US)

(72) Inventor: Joseph D. Paresi, Madison, CT (US)

( * ) Notice: Subject to any disclaimer, the term of this patent is extended or adjusted under 35 U.S.C. 154(b) by 0 days.

(21) Appl. No.: 14/801,032

(22) Filed: Jul. 16, 2015

(51) Int. Cl.
*G10D 7/12* (2006.01)
*G10G 5/00* (2006.01)

(52) U.S. Cl.
CPC ..... *G10G 5/005* (2013.01); *G10D 7/123* (2013.01)

(58) Field of Classification Search
CPC ..... G10D 7/123; G10G 5/005
USPC ..... 84/379, 377
See application file for complete search history.

(56) References Cited

U.S. PATENT DOCUMENTS 3,172,328 A * 3/1965 Haile ..... G10D 7/123 224/910
3,332,310 A * 7/1967 Pochobradsky ..... G10G 5/005 224/910
3,818,792 A * 6/1974 Gerbetz ..... G10G 5/005 84/379
4,287,803 A * 9/1981 Zema ..... G10H 3/12 84/379

(Continued)

OTHER PUBLICATIONS

The Hohner FlexRack found at: http://www.sweetwater.com/store/detail/HarpHoldFlex.

(Continued)

*Primary Examiner* — David Warren
*Assistant Examiner* — Christina Schreiber
(74) *Attorney, Agent, or Firm* — UConn IP Clinic; Michael A. Blake; Izick Vizel

(57) ABSTRACT

A harmonica automatic positioner, comprising: a shoulder yoke configured to be worn over the shoulders of a user, the shoulder yoke having a first end and a second end configured for resting on opposite sides of the chest of the user; a harmonica support frame, rotatably attached to the first end and second end, the harmonica support frame having a first member and a second member configured to rotatably attach to the first end and the second end of the shoulder yoke, where the harmonica support frame is adapted to be wearable on a chest of a user and comprises a plurality of fasteners configured to hold a harmonica; a clutch mechanism that rotatably joins the first end and the first member, and rotatably joins the second end and the second member, where the clutch mechanism is configured to hold the harmonica automatic positioner in alternatively an at rest position and an at ready position, where in the at rest position the harmonica is out of the way of the user's mouth, and where at the at ready position the harmonica is near the mouth of the user such that the user can play the harmonica; an actuator in operable communication with the clutch mechanism, and configured to actuate the clutch mechanism from the at rest position to the at ready position, and further configured to actuate the clutch mechanism from the at ready position to the at rest position; and a switch mechanism in communication with the actuator and configured to actuate the actuator. The disclosed invention also relates to A method of using a harmonica, the method comprising: actuating a harmonica automatic positioner to move a harmonica from a rest position to a ready position; playing the harmonica; and actuating the harmonica automatic positioner to move a harmonica from the ready position to the rest position.

13 Claims, 4 Drawing Sheets

(56) References Cited

U.S. PATENT DOCUMENTS

| | | | | | |
|---|---|---|---|---|---|
| 4,414,879 | A * | 11/1983 | Ruiz | G10D 7/123 | 84/379 |
| 4,713,999 | A * | 12/1987 | Burt | G10D 7/123 | 84/379 |
| 5,479,841 | A * | 1/1996 | Garrett | G10D 15/00 | 224/910 |
| 5,608,177 | A * | 3/1997 | Zadworny | G10D 7/123 | 224/910 |
| 5,619,001 | A * | 4/1997 | Pasin | G10D 7/123 | 16/329 |
| 5,929,352 | A * | 7/1999 | Gutc, Jr. | G10D 7/123 | 84/378 |
| 7,671,263 | B1 | 3/2010 | Coady | | |
| D633,554 | S * | 3/2011 | Nguyen | D17/13 | |
| 8,153,877 | B2 | 4/2012 | Coady | | |
| 8,362,346 | B1 * | 1/2013 | Prozinski | G10D 7/12 | 84/379 |
| 8,476,515 | B2 | 7/2013 | Coady | | |
| 8,802,950 | B2 * | 8/2014 | Bibollet | G10D 7/123 | 84/377 |
| 8,940,987 | B2 | 1/2015 | Kaynor | | |
| 8,993,864 | B1 * | 3/2015 | Cramer | 84/379 | |
| 2006/0096441 | A1 * | 5/2006 | Thibodeau | G10D 7/123 | 84/379 |
| 2011/0025455 | A1 * | 2/2011 | Whalen | G10H 1/0008 | 340/4.1 |
| 2013/0047817 | A1 * | 2/2013 | Kaynor | G10G 5/005 | 84/379 |
| 2015/0090097 | A1 * | 4/2015 | Kaynor | G10G 5/005 | 84/379 |
| 2015/0194140 | A1 * | 7/2015 | Kaynor | G10G 5/005 | 84/379 |

OTHER PUBLICATIONS

The SLK Sonnenschein Harmonica Rack https://www.youtube.com/watch?v=ToLyqwWv7lw.

Hi-Hat Clutches; including Yamaha, Gibraltar, Remo, and Zildjian, found at: http://www.guitarcenter.com/Hi-Hat-Clutches-Drum--Percussion-Clamps-Mounts-Holders.gc.

On-Stage MSA9501 Posi-Lok Clutch found at: http://www.amazon.com/On-Stage-MSA 9501-Posi-Lok-Clutch/dp/B0002E54YO.

* cited by examiner

HARMONICA AUTOMATIC POSITIONER AND METHOD

FIELD OF THE INVENTION

The present disclosure relates generally to harmonica holders, and particularly to automatically actuated harmonica holders.

BACKGROUND

It is a challenge for musicians to alternately sing and play the harmonica, while keeping the harmonica ready for use. Generally, when a musician sings and plays the harmonica she must move the harmonica out of the zone of vocal projection in order to sing unencumbered. This moving of the harmonica may cause an interruption or delay in readiness to proceed with the performance.

Utilizing the harmonica holders currently available does not provide for ease in the transition between singing and playing. The currently available devices are set in a fixed position and generally stay fixed throughout the performance, requiring the player to sing around the device.

There exists many situations where it is preferred that a harmonica be at the ready for a performer, without being an encumbrance.

Thus there is a need for a harmonica automatic positioner that overcomes these and other disadvantages.

SUMMARY

The disclosed invention relates to a harmonica automatic positioner, comprising: a shoulder yoke configured to be worn over the shoulders of a user, the shoulder yoke having a first end and a second end configured for resting on opposite sides of the chest of the user; a harmonica support frame, rotatably attached to the first end and second end, the harmonica support frame having a first member and a second member configured to rotatably attach to the first end and the second end of the shoulder yoke, where the harmonica support frame is adapted to be wearable on a chest of a user and comprises a plurality of fasteners configured to hold a harmonica; a clutch mechanism that rotatably joins the first end and the first member, and rotatably joins the second end and the second member, where the clutch mechanism is configured to hold the harmonica automatic positioner in alternatively an at rest position and an at ready position, where in the at rest position the harmonica is out of the way of the user's mouth, and where at the at ready position the harmonica is near the mouth of the user such that the user can play the harmonica; an actuator in operable communication with the clutch mechanism, and configured to actuate the clutch mechanism from the at rest position to the at ready position, and further configured to actuate the clutch mechanism from the at ready position to the at rest position; and a switch mechanism in communication with the actuator and configured to actuate the actuator.

The disclosed invention also relates to A method of using a harmonica, the method comprising: actuating a harmonica automatic positioner to move a harmonica from a rest position to a ready position; playing the harmonica; and actuating the harmonica automatic positioner to move a harmonica from the ready position to the rest position.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 1:
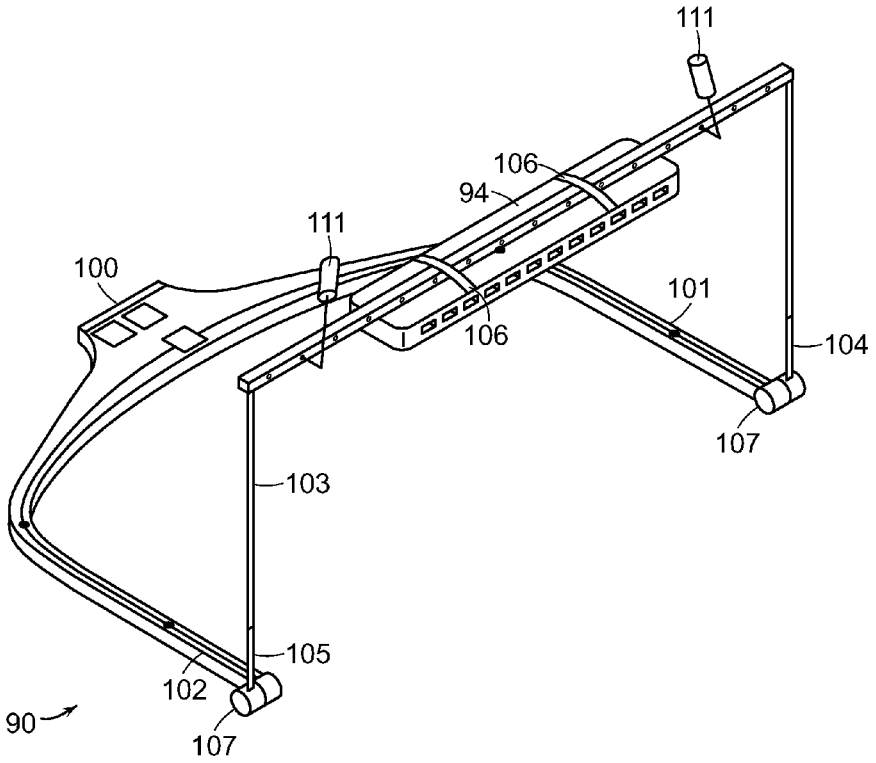
FIG. 1 is a perspective view of the harmonica automatic positioner.

FIG. 1 is a perspective view of the harmonica automatic positioner 90 in the ready position. The harmonica automatic positioner 90 comprises a shoulder yoke 100 adapted to be worn over the shoulders of a musician. The shoulder yoke may have a first end 101 and a second end 102 configured for resting on opposite sides of the chest of the musician. The harmonica automatic positioner 90 further comprises a harmonica support frame 103, the harmonica support frame 103 having a first member 104 and a second member 105 configured to attach to the first end 101 and the second end 102 of the shoulder yoke 100, wherein the harmonica support frame 103 is adapted to be wearable on a chest of a musician and comprises a plurality of fasteners 106 enabled to hold a harmonica 94 on the harmonica support frame 103. The harmonica automatic positioner 90 further comprises a clutch mechanism 107 that hingedly joins the first end 101 and the first member 104, and hingedly joins the second end 102 and the second member 105. The clutch mechanism 107 is configured to lock the harmonica automatic positioner 90 into at least an at rest position and an at ready position. The clutch mechanism 107 can be any suitable clutch, including but not limited to a wrap spring clutch, an electro-magnetic toothed clutch, a pneumatic clutch, or a hydraulic clutch.

Figure 2:
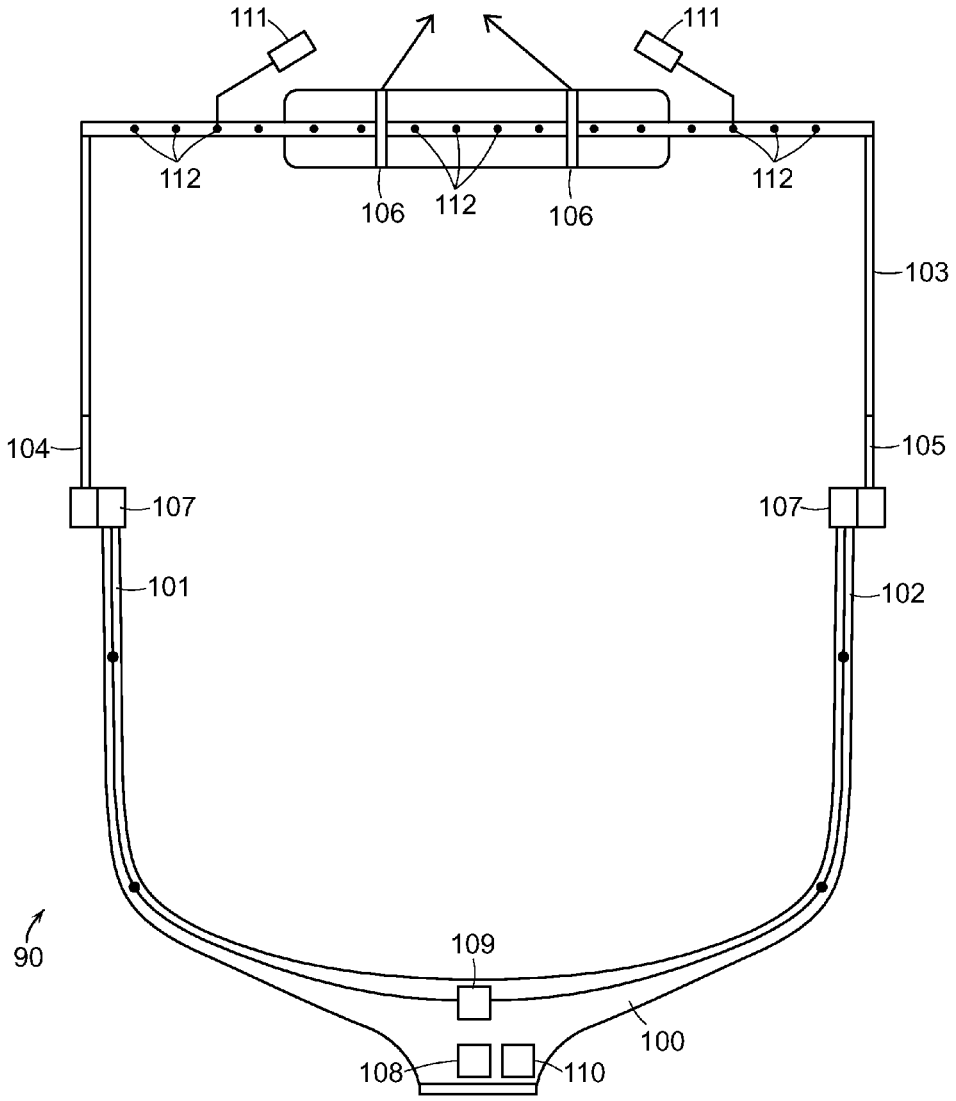
FIG. 2 is a top view of the harmonica automatic positioner, fully extended.

FIG. 2 is a top view of the harmonica automatic positioner 90 from FIG. 1, with the positioner in generally an at rest position. As can be seen in this view, an actuator 108 engages a gear and pulley system 109 to alternatingly bring the harmonica automatic positioner automatically into the rest position or the ready position. The actuator 108 can be any suitable actuator; including but not limited to an electric actuator, hydraulic actuator, mechanical actuator, a brushed DC motor, a brushless DC motor, a servomechanism, a stepper motor, or any other suitable actuator, hydraulic actuator, or magnetic actuator. A battery 110 can be used to power the harmonica automatic positioner 90. One or more condenser microphones 111 can be attached to the harmonica support frame 103. There may be a plurality of through-holes 112 in the harmonica support frame 103.

The through-holes 112 may be mounting holes for future options and to mount the support brackets of the harmonica or harmonicas and microphones. The holder itself may be hollow to accommodate the cables that may run from the back of the harmonica automatic positioner 90 to the pulley system to move the positioner from the at rest position to an at ready position, and vice versa. The angle between the at ready position and the at rest position may be about 108 degrees, but any suitable angle may be used.

Figure 3:
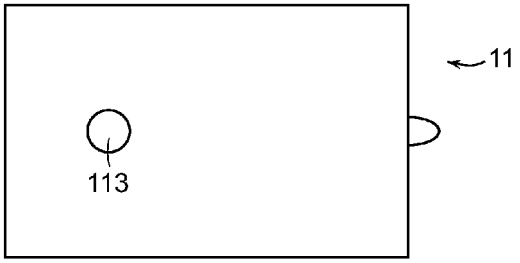
FIG. 3 is a top view of a foot-operated switch mechanism to actuate the harmonica automatic positioner.

FIG. 3 illustrates a nonexclusive example of a foot pedal 11 example of the switch mechanism. The switch mechanism 11 can be a foot pedal or a wireless foot pedal with a button 113 to actuate the harmonica positioner. Thus, in use, a player may activate the switch with her foot, and cause the harmonica automatic positioner 90 to move the harmonica from an at rest position to an at ready position, and vice versa.

Figure 4:
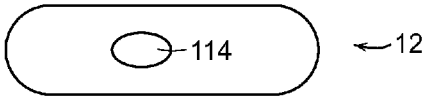
FIG. 4 is a top view of a button for remote actuation of the harmonica automatic positioner.

FIG. 4 illustrates a nonexclusive example of a push-button 12 example of the switch mechanism. The switch mechanism 12 can be a remote switch or a wireless remote switch with a button 114 to actuate the harmonica automatic positioner. The switch mechanism may be placed in the player's pocket for easy access, or attached to her clothing, or anywhere where easily accessible by the player. In use, a player may activate the switch cause the harmonica automatic positioner 90 to move the harmonica from an at rest position to an at ready position, and vice versa.

Figure 5:
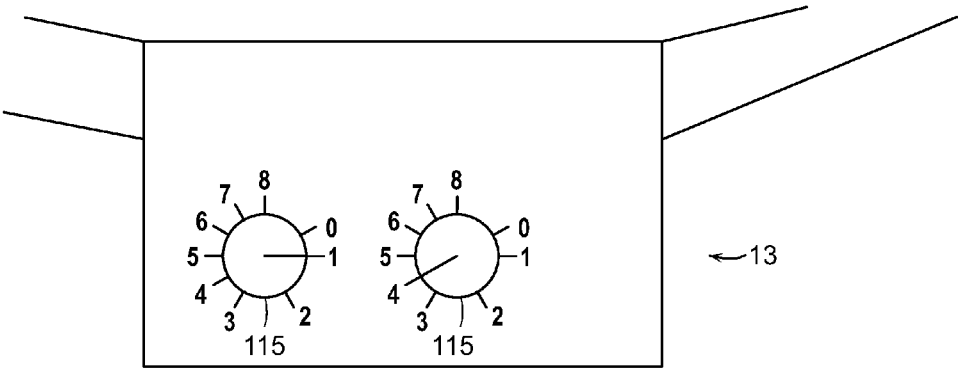
FIG. 5 is a front view of the motor control board for metering the actuation of the harmonica automatic positioner.

FIG. 5 illustrates a nonexclusive example of the motor control board 13. The adjustment knobs 115 can be used to control the speed at which the harmonica automatic positioner moves from the rest to the ready position and the ready position to the rest position. The motor control board can be a variable speed DC drive.

Figure 6:
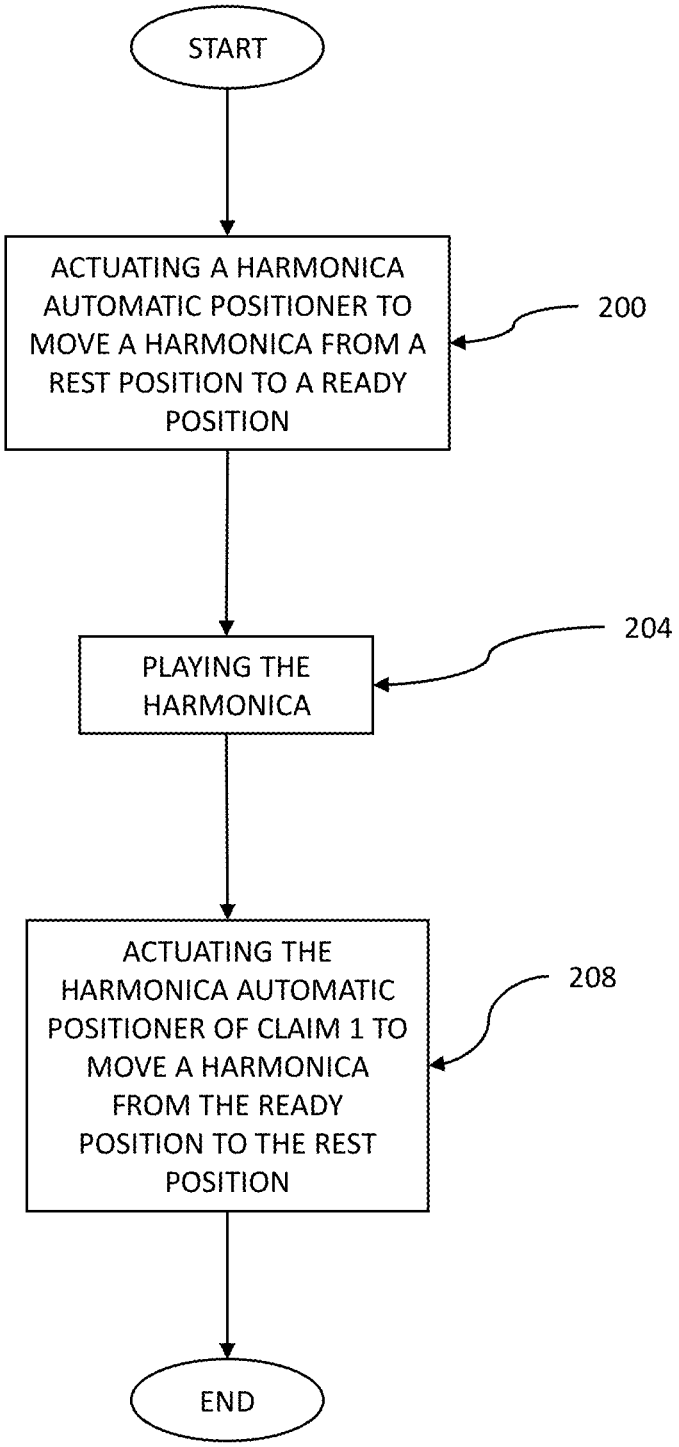
FIG. 6 is a flowchart showing one embodiment of the disclosed method.

FIG. 6 discloses a method of using the harmonica. The method may be used for playing and singing with a harmonica. In other embodiments, the method may be used as means of providing pulmonary function therapy. At act 200, a user actuates a harmonica automatic positioner to move a harmonica from a rest position to a ready position. At act 204, the user plays the harmonica. At act 208, the user actuates the harmonica automatic positioner to move the harmonica from the ready position to the rest position.

The harmonica automatic positioner 90 can be used to alternately sing or play a harmonica. The player can activate the switch mechanism to actuate the harmonica automatic positioner to bring the attached harmonica to a position ready to be played, at a speed defined by the player. When desired, the player can activate the switch mechanism to actuate the harmonica automatic positioner to bring the attached harmonica to a rest position, out of the way of the player. In one non-limiting use, when the harmonica automatic positioner is in the rest position, the player may sing.

The harmonica automatic positioner can be used for pulmonary function therapy. An automated program can be created to raise or lower the harmonica to enable the patient to play the harmonica for defined periods of time with defined periods of rest.

The harmonica automatic positioner can be used in any situation where it is preferred that a harmonica be automatically ready for use or alternately out of the way of the wearer.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The disclosed embodiments are illustrative, not restrictive. While specific configurations of the harmonica automatic positioner have been described, it is understood that the present invention can be applied to a wide variety of harmonica automatic positioners. There are many alternative ways of implementing the invention.

What is claimed is:

1. A harmonica automatic positioner, comprising:

a shoulder yoke configured to be worn over the shoulders of a user, the shoulder yoke having a first end and a second end configured for resting on opposite sides of the chest of the user;

a harmonica support frame, rotatably attached to the first end and second end, the harmonica support frame having a first member and a second member configured to rotatably attach to the first end and the second end of the shoulder yoke, wherein the harmonica support frame is configured to be wearable on a chest of a user and comprises a plurality of fasteners configured to hold a harmonica;

a clutch mechanism that rotatably joins the first end and the first member, and rotatably joins the second end and the second member, wherein the clutch mechanism is configured to hold the harmonica automatic positioner in alternatively an at rest position and an at ready position, wherein in the at rest position the harmonica is out of the way of the user's mouth, and wherein at the at ready position the harmonica is near the mouth of the user such that the user can play the harmonica;

an actuator in operable communication with the clutch mechanism, and configured to actuate the clutch mechanism from the at rest position to the at ready position, and further configured to actuate the clutch mechanism from the at ready position to the at rest position;

a switch mechanism in communication with the actuator and configured to actuate the actuator and;

a motor control board in communication with the actuator and configured to control the speed of the actuator.

2. The harmonica automatic positioner of claim 1, wherein the actuator comprises an electric actuator.

3. The harmonica automatic positioner of claim 2, wherein the electric actuator is an electric actuator selected from the group comprising: a brushed DC motor, a brushless DC motor, a servomechanism, and a stepper motor.

4. The harmonica automatic positioner of claim 1, wherein the switch mechanism comprises a remote switch.

5. The harmonica automatic positioner of claim 4, wherein the remote switch is selected from the group consisting of a wireless remote switch, a foot pedal, and a wireless foot pedal.

6. The harmonica automatic positioner of claim 1, further comprising a gear and pulley system in operable communication with the actuator.

7. The harmonica automatic positioner of claim 1, wherein the actuator is selected from the group consisting of a hydraulic actuator, a magnetic actuator, a mechanical actuator.

8. The harmonica automatic positioner of claim 1, wherein the switch mechanism comprises a push-button switch.

9. The harmonica automatic positioner of claim 1, wherein the clutch mechanism is selected from the group consisting of a wrap spring clutch, an electro-magnetic toothed clutch, a pneumatic clutch, and a hydraulic clutch.

10. The harmonica automatic positioner of claim 1, wherein the motor control board comprises a variable speed dc drive.

11. The harmonica automatic positioner of claim 1, further comprising a plurality of condenser microphones attached to the harmonica support frame.

12. The harmonica automatic positioner of claim 1, wherein the plurality of fasteners are terminally attached to the harmonica support frame and configured to removeably fasten to a harmonica.

13. The harmonica automatic positioner of claim 1, further comprising a plurality of through-holes in the harmonica support frame.

* * * * *